US007207112B2

(12) United States Patent
Yeh

(10) Patent No.: US 7,207,112 B2
(45) Date of Patent: Apr. 24, 2007

(54) COMBINATION HAIRDRESSING SCISSOR ASSEMBLY

(76) Inventor: Wen-Ya Yeh, 15F-2, No. 18, Chorng Shyue Rd., Tainan City (TW)

( * ) Notice: Subject to any disclaimer, the term of this patent is extended or adjusted under 35 U.S.C. 154(b) by 0 days.

(21) Appl. No.: 11/034,669

(22) Filed: Jan. 12, 2005

(65) Prior Publication Data

US 2006/0150424 A1 Jul. 13, 2006

(51) Int. Cl.
*B26B 13/00* (2006.01)

(52) U.S. Cl. ..... 30/226; 30/254

(58) Field of Classification Search ..... 30/195–197, 30/226, 227, 254, 260; 24/614, 615, 618, 24/625, 627, 617, 697.1; 403/326, 329, DIG. 11, 403/263; D8/5, 57
See application file for complete search history.

(56) References Cited

U.S. PATENT DOCUMENTS

| | | | | |
|---|---|---|---|---|
| 367,578 | A * | 8/1887 | Babb | 403/329 X |
| 1,328,488 | A * | 1/1920 | Bowden | 403/329 X |
| 4,012,155 | A * | 3/1977 | Morris | 403/290 |
| 4,898,493 | A * | 2/1990 | Blankenburg | 403/326 |
| 5,176,465 | A * | 1/1993 | Holsted | 403/379.6 |
| 5,379,496 | A * | 1/1995 | Krauss | 24/625 |
| 5,875,553 | A * | 3/1999 | Geib, Jr. et al. | 30/226 |
| 5,996,592 | A * | 12/1999 | Choy | 30/226 X |
| 6,192,590 | B1 | 2/2001 | Yeh | |
| 6,199,328 | B1 * | 3/2001 | McGrath et al. | 52/127.1 |
| 6,434,833 | B1 | 8/2002 | Yeh | |
| 6,491,587 | B1 * | 12/2002 | Rich | 403/326 X |
| 6,557,263 | B1 * | 5/2003 | Yeh | 30/226 |
| 6,601,304 | B2 * | 8/2003 | Yeh | 30/226 |
| 6,990,739 | B2 * | 1/2006 | Yeh | 30/226 |
| 2003/0051349 | A1 * | 3/2003 | Yeh | 30/254 |
| 2003/0079352 | A1 * | 5/2003 | Yeh | 30/226 |
| 2004/0078982 | A1 * | 4/2004 | Yeh | 30/226 |
| 2004/0255469 | A1 * | 12/2004 | Yeh | 30/226 |

FOREIGN PATENT DOCUMENTS

| | | |
|---|---|---|
| EP | 1 491 301 A1 | 12/2004 |
| GB | 2 337 721 A | 12/1999 |

* cited by examiner

*Primary Examiner*—Clark F. Dexter
(74) *Attorney, Agent, or Firm*—Pro-Techtor Int'l Services

(57) ABSTRACT

A combination hairdressing scissor assembly is disclosed to include a plurality of male connecting members and a plurality of female connecting members symmetrically provided at two opposite sides of each pair of hairdressing scissors for enabling a plural pairs of hairdressing scissors to be connected in parallel by fastening the male connecting members of one pair of hairdressing scissors into the female connecting members of another pair of hairdressing scissors, each female connecting member having a front receiving open chamber, each male connecting member having two parallel insertion blocks engageable into the front receiving open chamber of the corresponding female connecting member by force.

1 Claim, 17 Drawing Sheets

COMBINATION HAIRDRESSING SCISSOR ASSEMBLY

BACKGROUND OF THE INVENTION

1. Field of the Invention

The present invention relates to hairdressing scissors and more particularly, to a combination hairdressing scissor assembly.

2. Description of the Related Art

FIG. 1 is an exploded view of a hairdressing scissor assembly according to U.S. Pat. No. 6,434,833, which is an invention of the present inventor. According to this design, the first and second cutting members 10,20 of each scissor 1 have sleeves 13 and 23 and engaging members 15 and 25 symmetrically disposed at two opposite sides. By engaging the engaging members 15 and 25 at one scissor 1 into the sleeves 13 and 23 at the other scissor 1, two scissors 1 are secured together. This design of hairdressing scissor assembly is still not satisfactory in function. Because the connection between the respective-engaging members 15 and 25 and the respective sleeves 13 and 23 is a "sleeve joint", the respective engaging members 15 and 25 may easily be separated from the respective sleeves 13 and 23 by accident. Further, because same pitch is provided between each two scissors, the scissors cannot be adjusted to achieve a stepped cutting subject to the shape and amount of hair of different clients, showing a stepped sense of beauty.

SUMMARY OF THE INVENTION

The present invention has been accomplished under the circumstances in view.

It is the main object of the present invention to provide a combination hairdressing scissor assembly, which allows plural pairs of hairdressing scissors to be connected in parallel at same or different elevations to fit different hair trimming requirements.

It is another object of the present invention to provide a combination hairdressing scissor assembly, which keeps pairs of hairdressing scissors connected in parallel at a different pitch to fit different hair cutting requirements.

According to one aspect of the present invention, the combination hairdressing scissor assembly comprises a plurality of male connecting members and a plurality of female connecting members symmetrically provided at two opposite sides of each pair of hairdressing scissors for enabling plural pairs of hairdressing scissors to be connected in parallel by fastening the male connecting members of one pair of hairdressing scissors into the female connecting members of another pair of hairdressing scissors. Each female connecting member has a front receiving open chamber. Each male connecting member has two parallel insertion blocks engageable into the front receiving open chamber of the corresponding female connecting member by force.

According to another aspect of the present invention, the male connecting members and the female connecting members can be provided at different elevations such that the pairs of hairdressing scissors can be connected in parallel at different elevations.

According to still another aspect of the present invention, the male connecting members or female connecting members can be prepared at different sizes such that the pairs of hairdressing scissors are kept spaced from one another at a different pitch to fit different hair cutting requirements when connected together.

DETAILED DESCRIPTION OF THE PREFERRED EMBODIMENT

Figure 1:
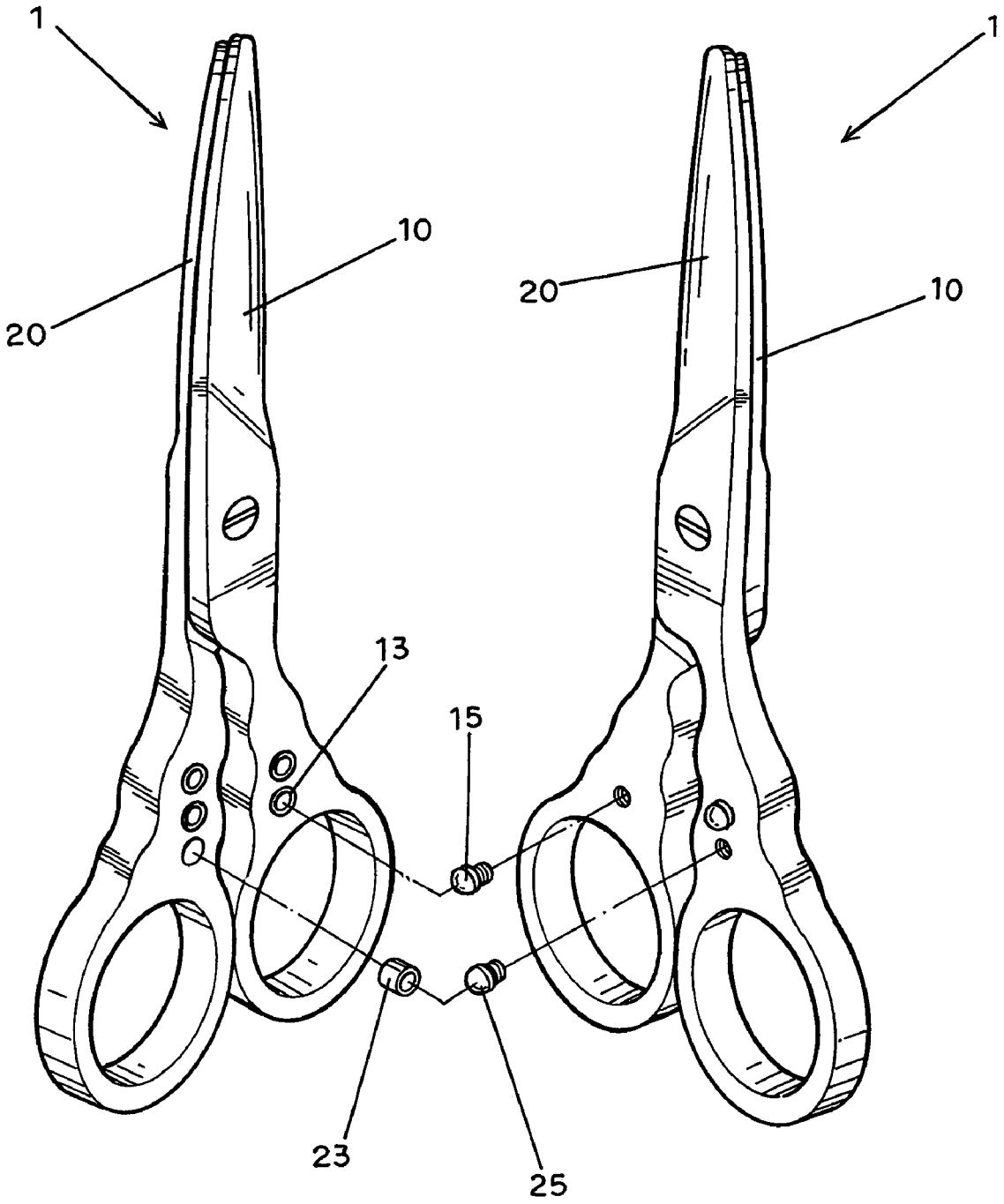
Fig. 1 (Prior Art)
FIG. 1 is an exploded view of a hairdressing scissor assembly according to U.S. Pat. No. 6,434,833.
Figure 2:
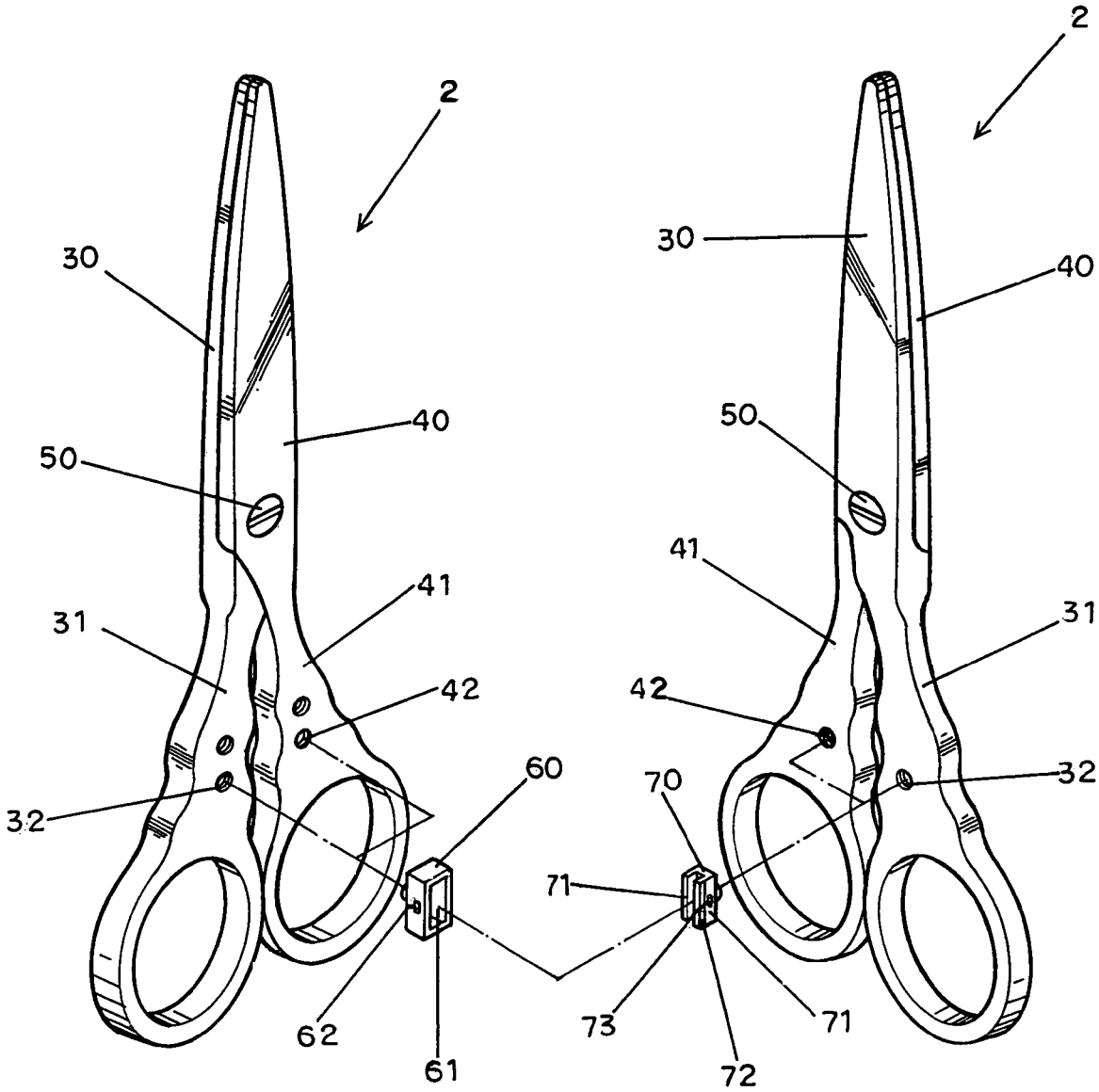
FIG. 2 is an exploded view of a combination hairdressing scissor assembly according to a first embodiment of the present invention.
Figure 3:
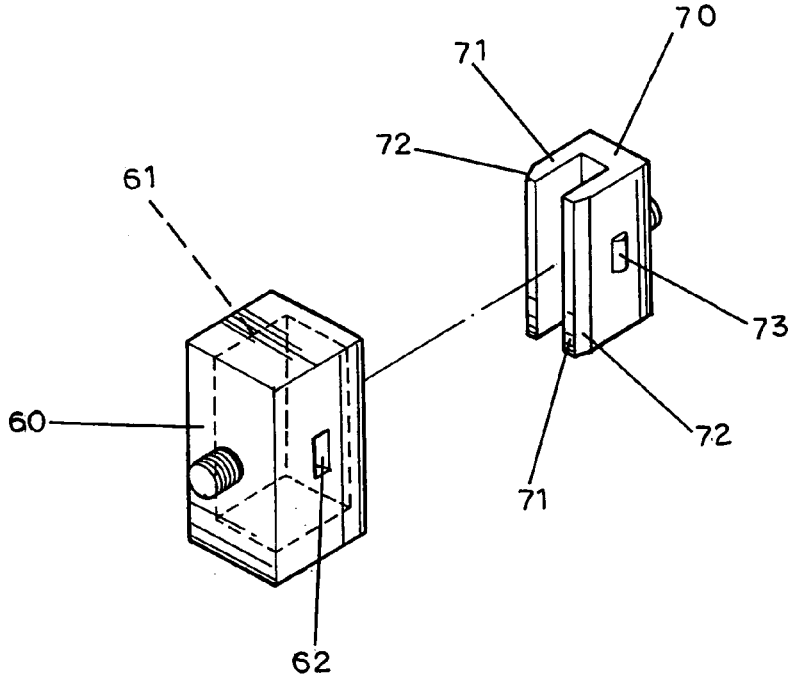
FIG. 3 is a perspective view of a female connecting member and a male connecting member for the combination hairdressing scissor assembly according to the first embodiment of the present invention.

Referring to FIGS. 2 and 3, a combination hairdressing scissor assembly in accordance with the first embodiment of the present invention is shown comprising pairs of hairdressing scissors 2 each having first and second cutting members 30 and 40 that are pivotably connected together by a pivot 50. The first cutting member 30 comprises a first handle 31 on an end thereof. The second cutting member 40 comprises a second handle 41 on an end thereof. The first handle 31 and the second handle 41 each comprise at least one screw hole 32 or 42 at each of the two opposite sides thereof. Male connecting members 70 and female connecting members 60 are respectively fastened to the screw holes 32 and 42 of the handles 31 and 41 of the first and second cutting members 30 and 40 at two opposite side. Each female connecting member 60 comprises a receiving open chamber 61 facing the front side thereof, and a retaining hole 62 in one lateral side in communication with the receiving open chamber 61. Each male connecting member 70 comprises two parallel insertion blocks 71 insertable into the receiving open chamber 61, each insertion block 71 having a beveled front guide portion 72, and a retaining stub rod 73 protruding from the outer surface of one of the insertion blocks 71 for engaging the corresponding retaining hole 62. According to this embodiment, the female connecting member 60 and the male connecting member 70 are respectively fastened to a respective screw hole 42 or 32. Alternatively, the female connecting member 60 and the male connecting member 70 can be respectively fastened to the handle 41 or 31 through a plug joint, by means of the application of an adhesive, by welding, or by means of any of a variety of conventional techniques.

Figure 5:
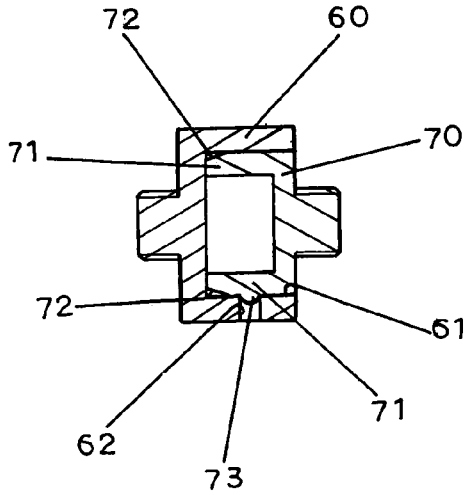
FIG. 5 corresponds to FIG. 4, showing the retaining block of the male connecting member engaged into the retaining hole of the female connecting member.
Figure 4:
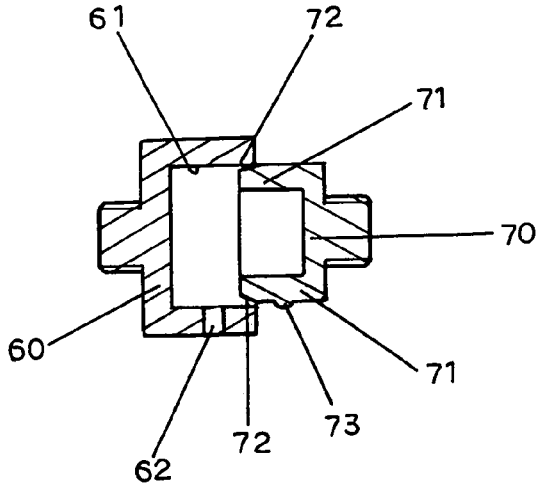
FIG. 4 is a sectional view showing insertion of the parallel sidewalls of the male connecting member into the receiving open chamber of the female connecting member.
Figure 6:
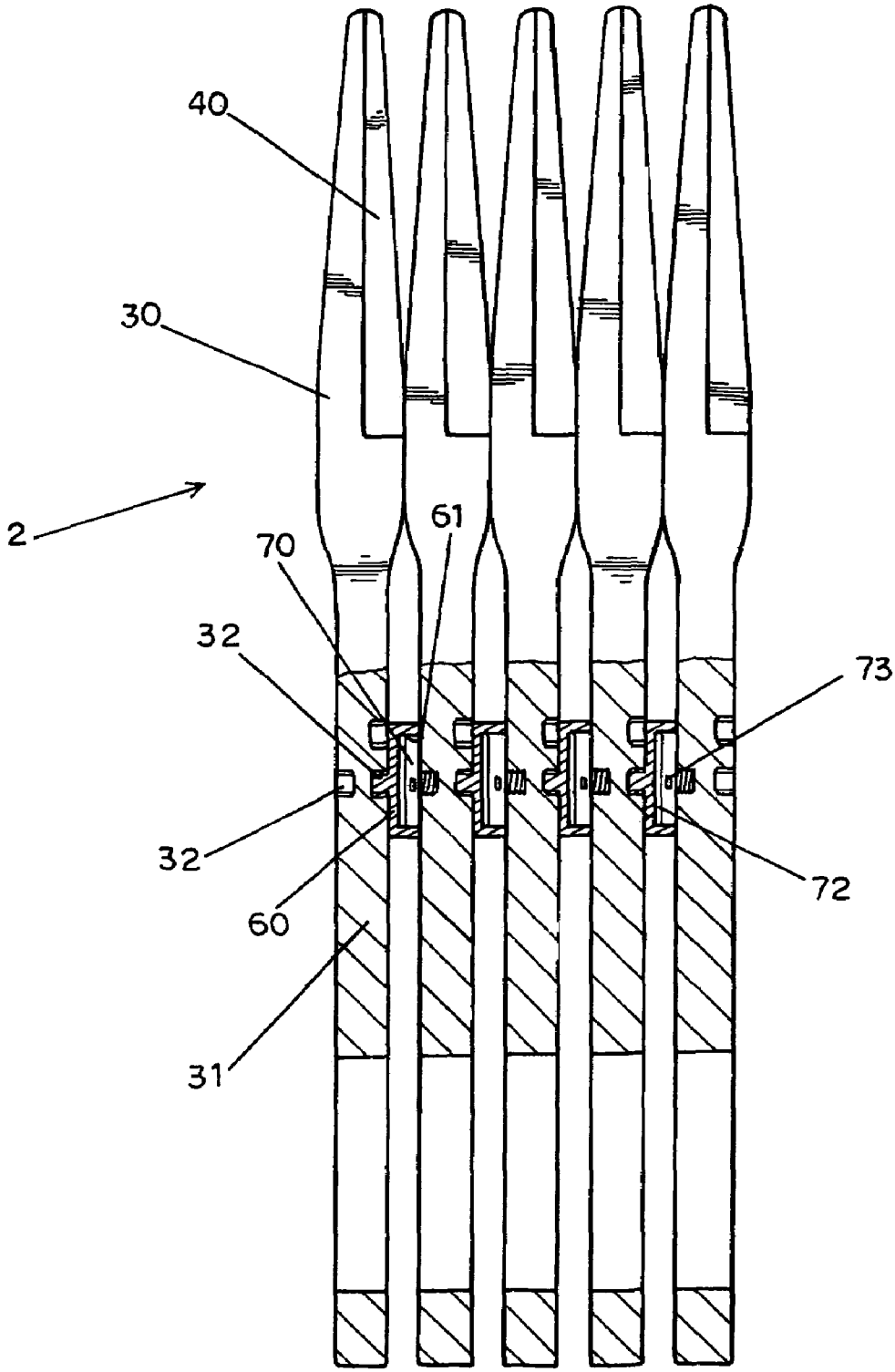
FIG. 6 is a sectional view showing plural pairs of hairdressing scissors connected in parallel at the same elevation according to the first embodiment of the present invention.

By means of engaging the parallel insertion blocks 71 of each of the male connecting members 70 at the handles 31 and 41 of the first and second cutting member 30 and 40 of one pair of scissors into the receiving open chambers 61 of the corresponding female connecting members 60 at the handles 31 and 41 of the first and second cutting member 30 and 40 of another pair of scissors (see FIG. 4) to force the respective retaining stub rods 73 into the respective retaining holes 62 (see FIG. 5), plural pairs of scissors 2 are connected in parallel (see FIG. 6). Further, because each insertion block 71 has a beveled front guide portion 72, the insertion blocks 71 of the male connecting member 70 can easily be forced into the receiving open chamber 61 of the corresponding female connecting member 60.

Figure 7:
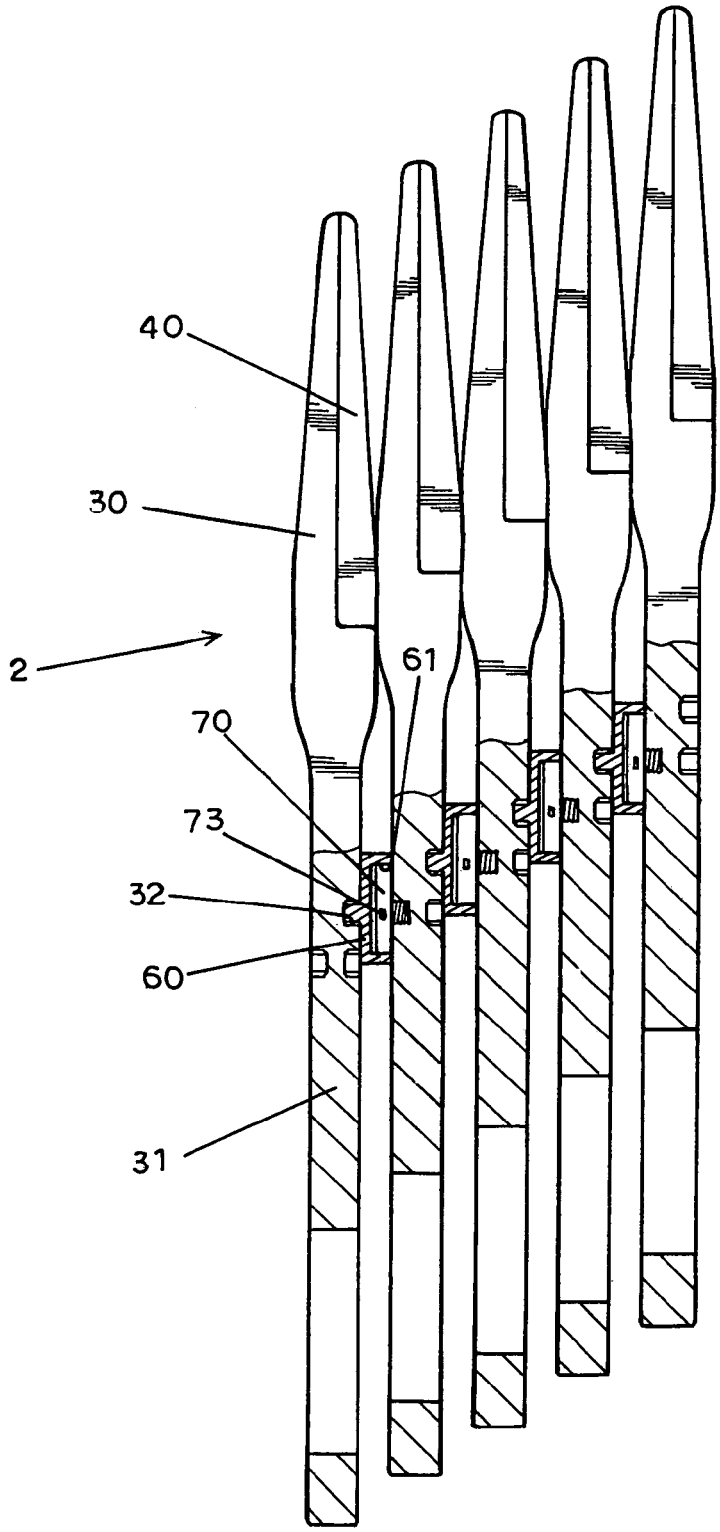
FIG. 7 is a sectional view showing plural pairs of hairdressing scissors connected in parallel at different elevations according to the first embodiment of the present invention.

Further, the handles 31 and 41 can be made having vertically spaced screw holes 32 or 42 such that the female connecting members 60 and the male connecting members 70 can be respectively installed in the handles 31 and 41 of the first and second cutting member 30 and 40 at different elevations for enabling a plural pairs of hairdressing scissors 2 to be connected in parallel at different elevations (see FIG. 7) for thinning and trimming the hair, causing the hair to show a stepped sense of beauty.

Figure 8:
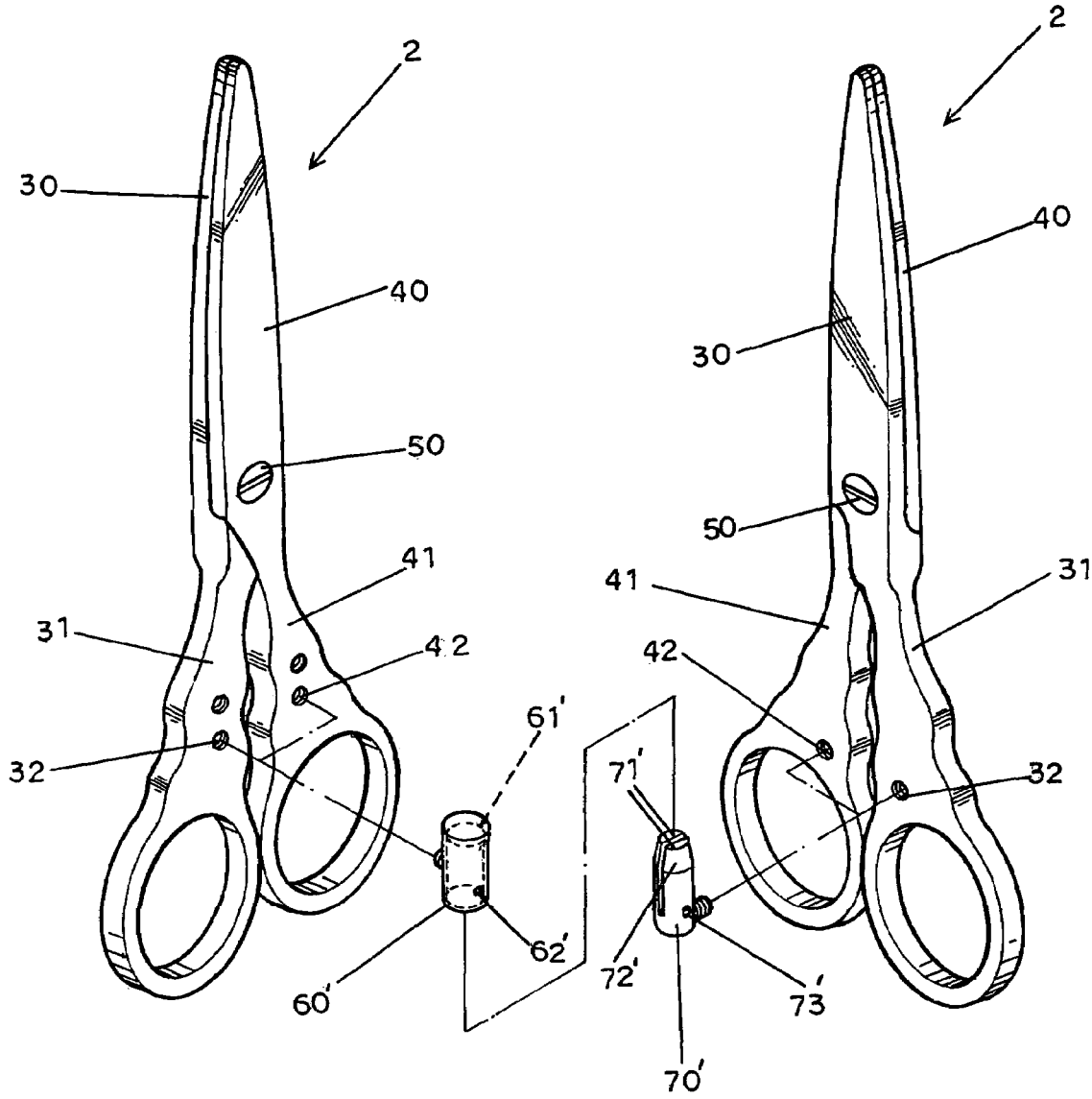
FIG. 8 is an exploded view of a combination hairdressing scissor assembly according to a second embodiment of the present invention.
Figure 9:
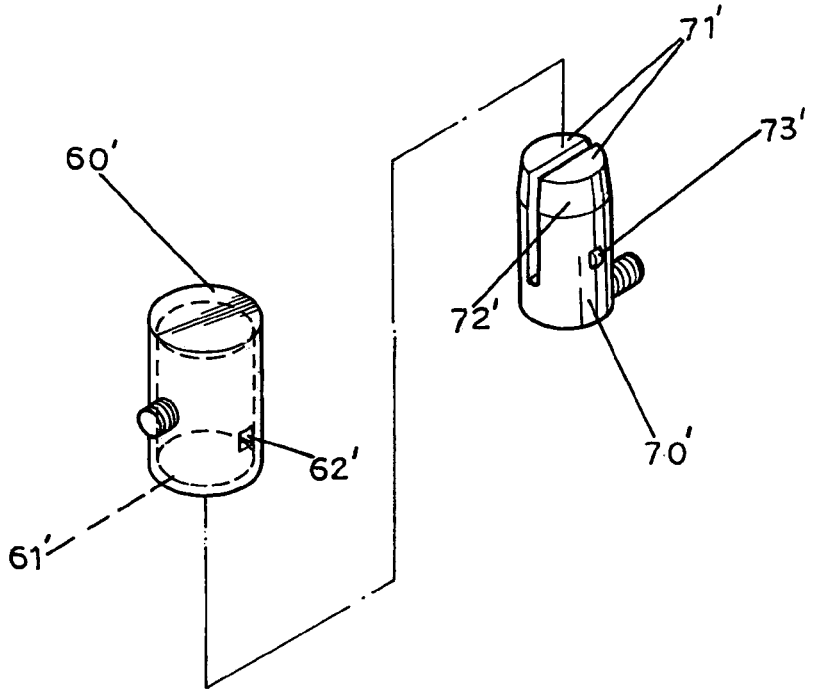
FIG. 9 is a perspective view of a female connecting member and a male connecting member for the combination hairdressing scissor assembly according to the second embodiment of the present invention.
Figure 11:
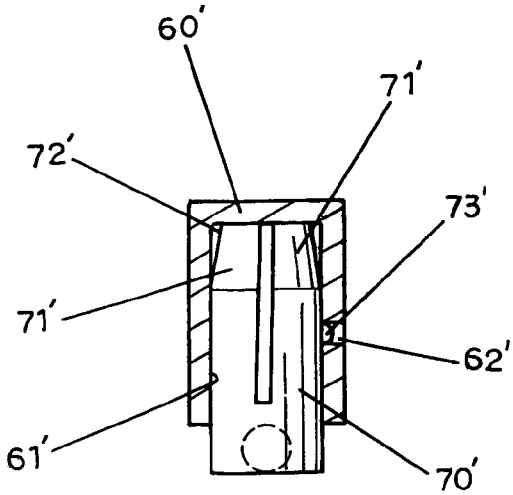
FIG. 11 corresponds to FIG. 10, showing the retaining block of the male connecting member engaged into the retaining hole of the female connecting member.
Figure 10:
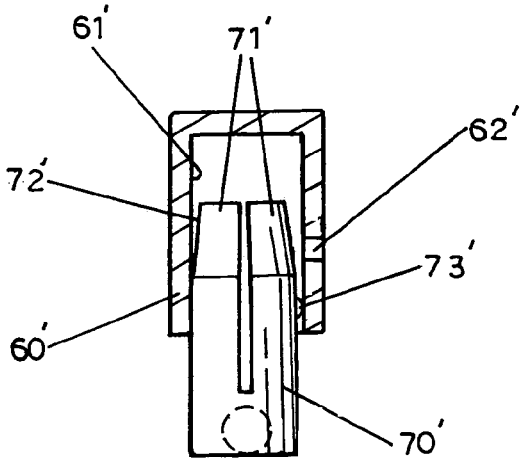
FIG. 10 is a sectional view showing insertion of the male connecting member into the receiving open chamber of the female connecting member according to the second embodiment of the present invention.
Figure 12:
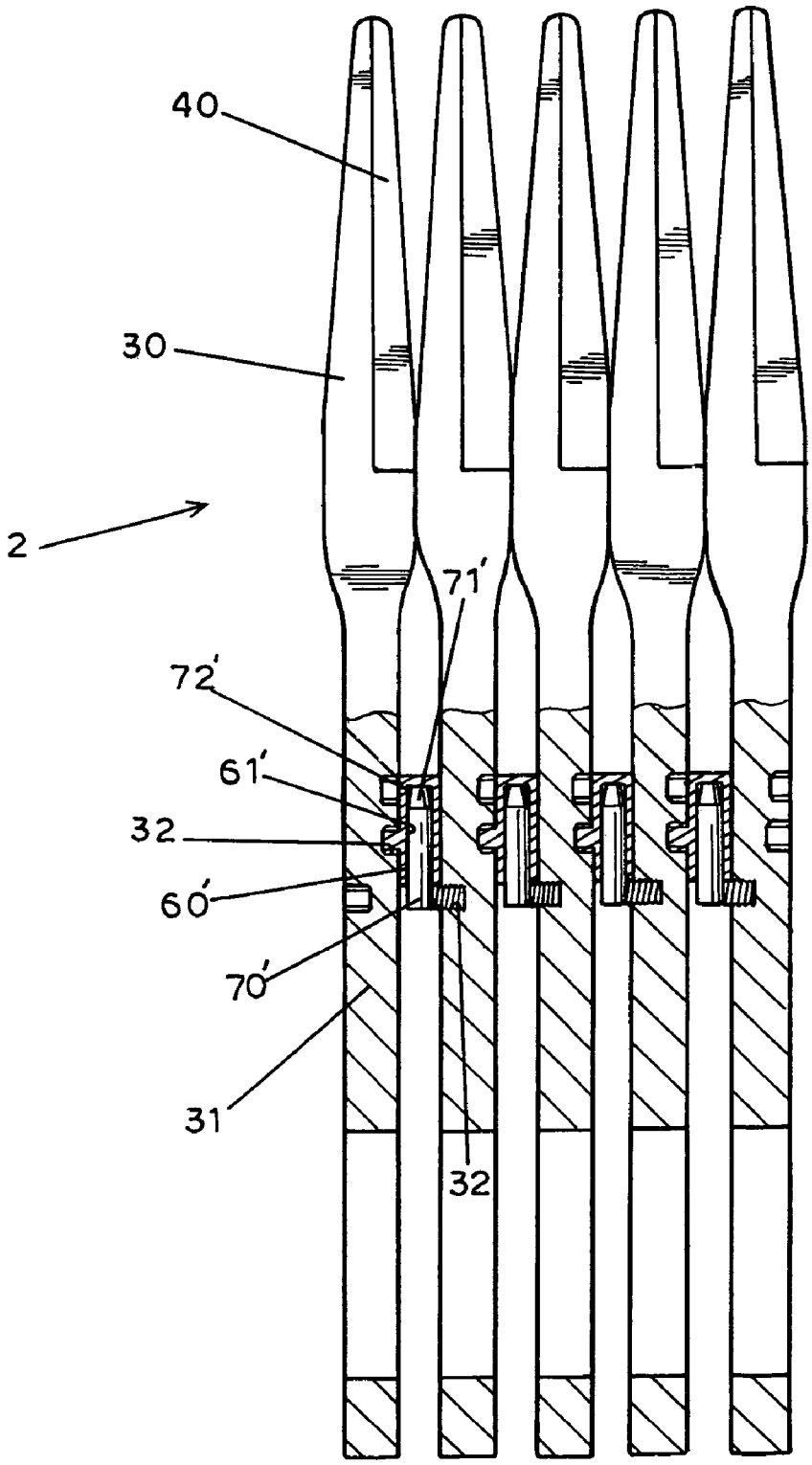
FIG. 12 is a sectional view showing plural pairs of hairdressing scissors connected in parallel at the same elevation according to the second embodiment of the present invention.

FIGS. 8 and 9 show a combination hairdressing scissor assembly 2 according to the second embodiment of the present invention. This embodiment is substantially similar to the aforesaid embodiment with the exception of the structure of the female connecting member and the male connecting member. According to this embodiment, the female connecting member 60' and the male connecting member 70' have a cylindrical shape. The female connecting member 60' has a bottom open chamber 61' adapted to receive the corresponding male connecting member 70', and a retaining hole 62' cut through the peripheral wall in communication with the bottom open chamber 61'. The male connecting member 70' is a split member comprising two insertion blocks 71' and a retaining stub rod 73' protrudes from the peripheral wall of one of the insertion blocks 71'. The insertion blocks 71' each have a beveled guide 72'.

Figure 13:
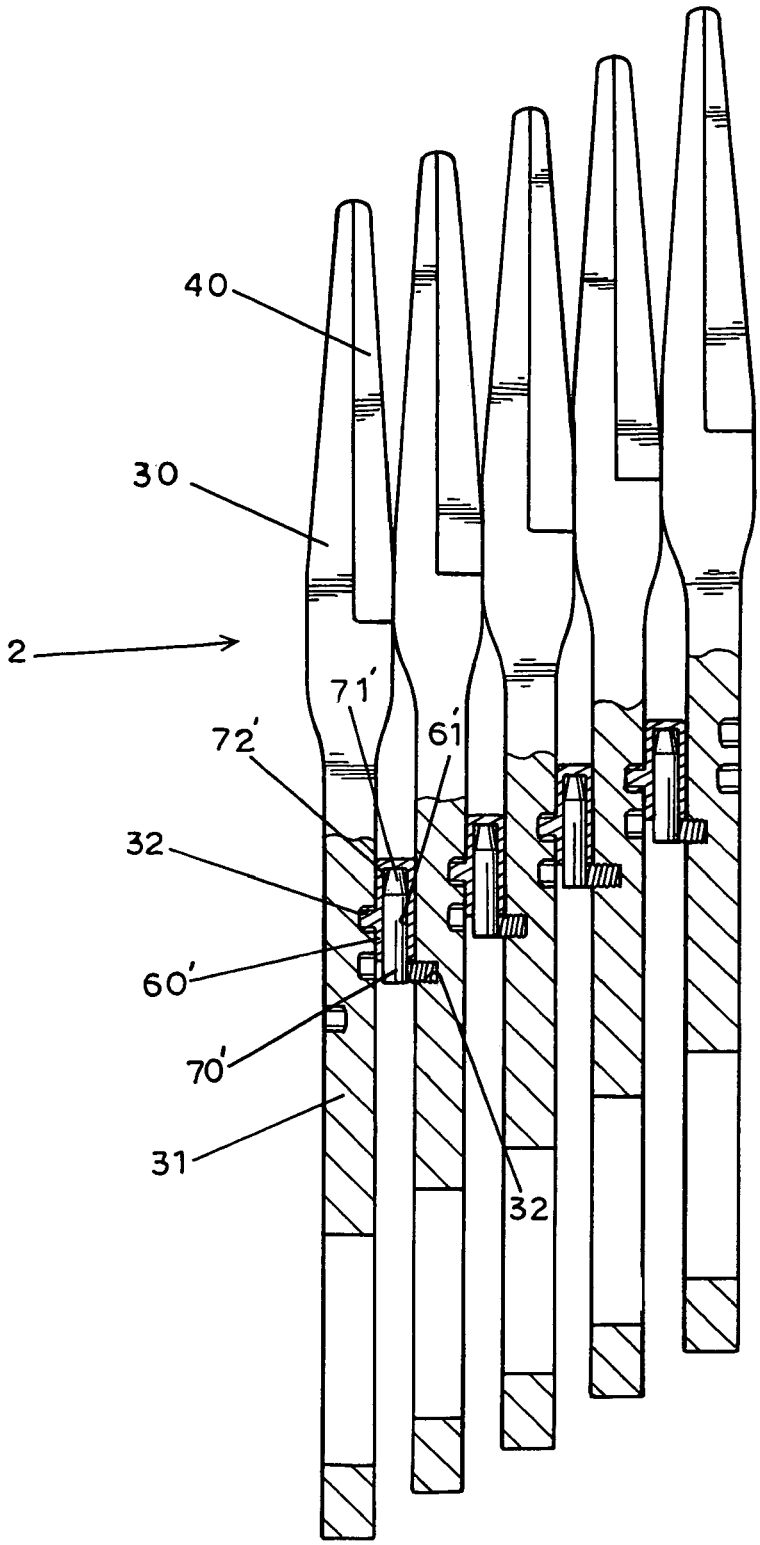
FIG. 13 is a sectional view showing plural pairs of hairdressing scissors connected in parallel at different elevations according to the second embodiment of the present invention.

Referring to FIGS. 10~13, by means of engaging the insertion blocks 71' of each of the male connecting members 70' at the handles 31 and 41 of the first and second cutting member 30 and 40 of one pair of scissors vertically upwardly into the bottom open chambers 61' of the corresponding female connecting members 60' at the handles 31 and 41 of the first and second cutting member 30 and 40 of another pair of scissors (see FIG. 10) to force the respective retaining stub rods 73' into the respective retaining holes 62' (see FIG. 11), plural pairs of scissors 2 are connected in parallel at the same elevation (see FIG. 12) or at different elevations (see FIG. 13).

Figure 14:
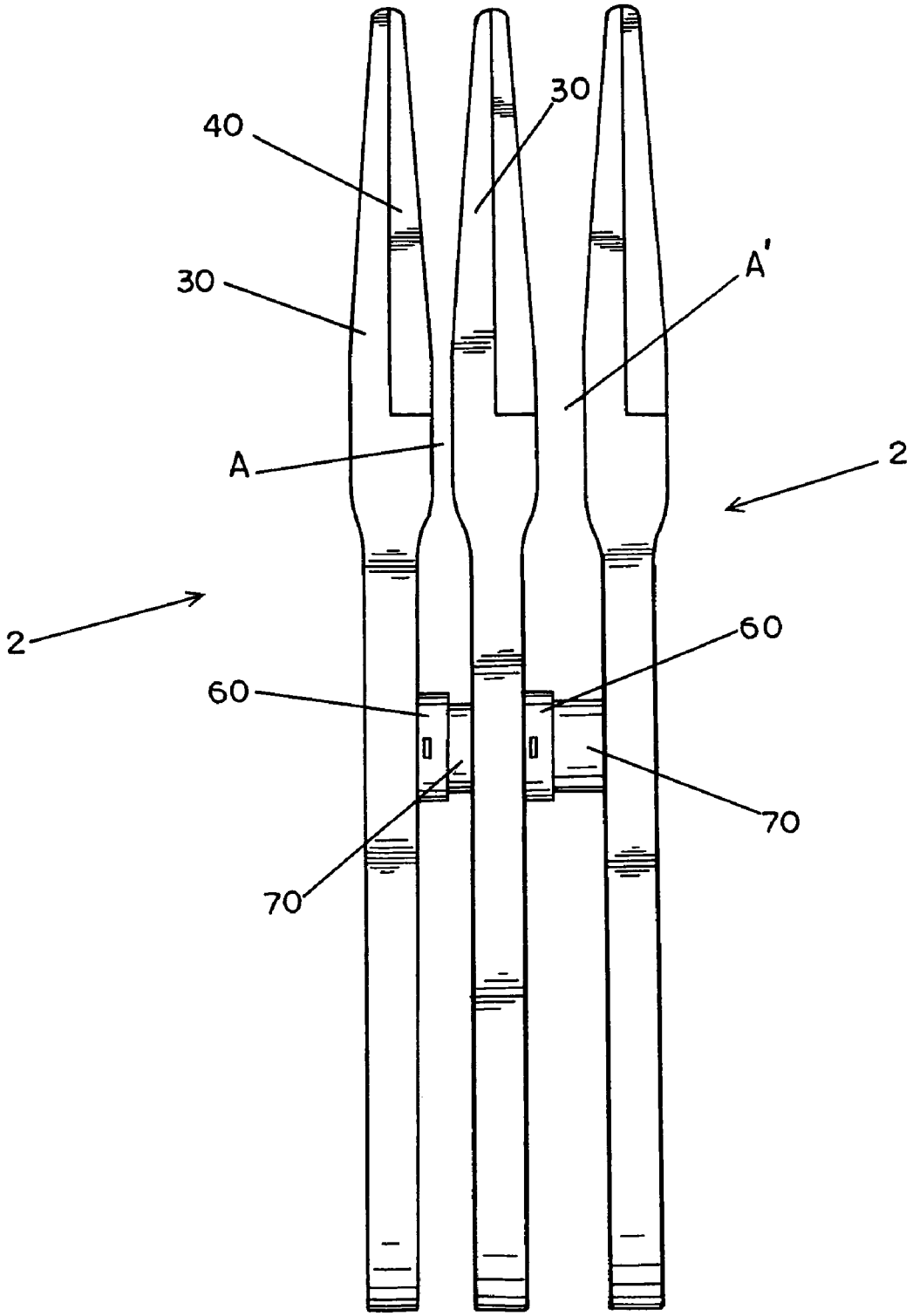
FIG. 14 is a side view of a combination hairdressing scissor assembly according to a third embodiment of the present invention.

FIG. 14 is a side view of a combination hairdressing scissor assembly 2 according to the third embodiment of the present invention. This embodiment is substantially similar to the embodiment shown in FIG. 3 with the exception that the male connecting members 70 have different lengths so that the pairs of hairdressing scissors 2 are kept spaced from one another at a different pitch A or A' (the female connecting members 60' of the embodiment shown in FIG. 9 may be made having different diameters such that the pairs of hairdressing scissors can be kept spaced from one another at a different pitch).

Figure 15:
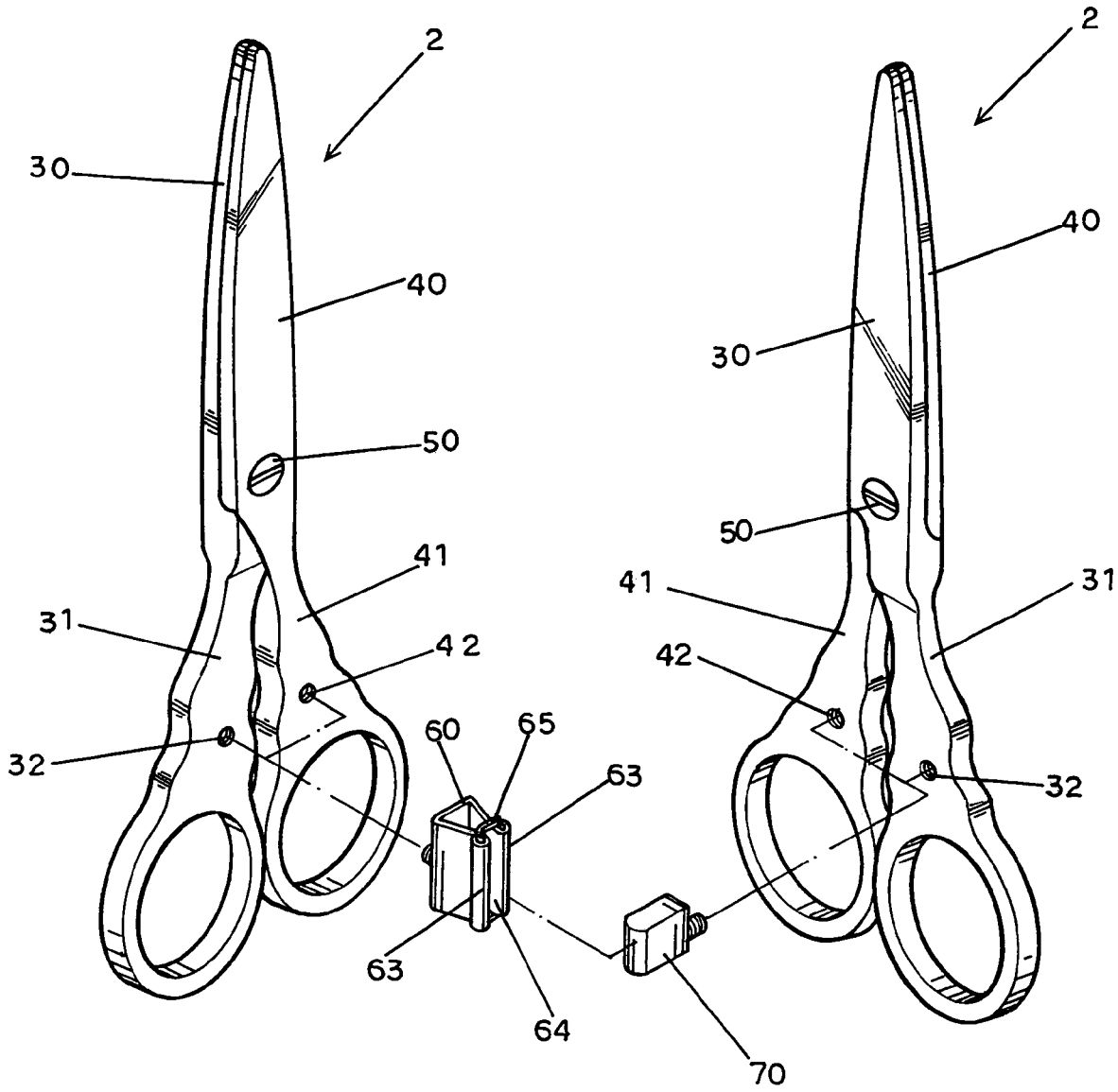
FIG. 15 is an exploded view of a combination hairdressing scissor assembly according to a fourth embodiment of the present invention.
Figure 16:
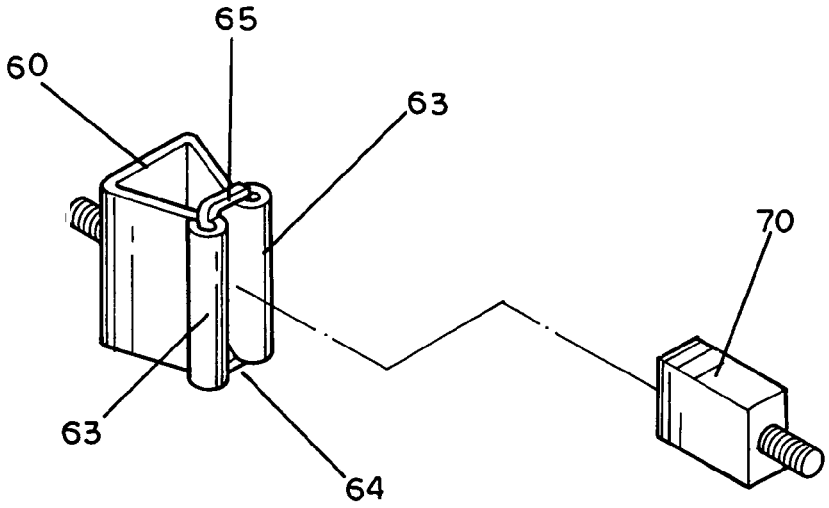
FIG. 16 is a perspective view of a female connecting member and a male connecting member for the combination hairdressing scissor assembly according to the fourth embodiment of the present invention.
Figure 17:
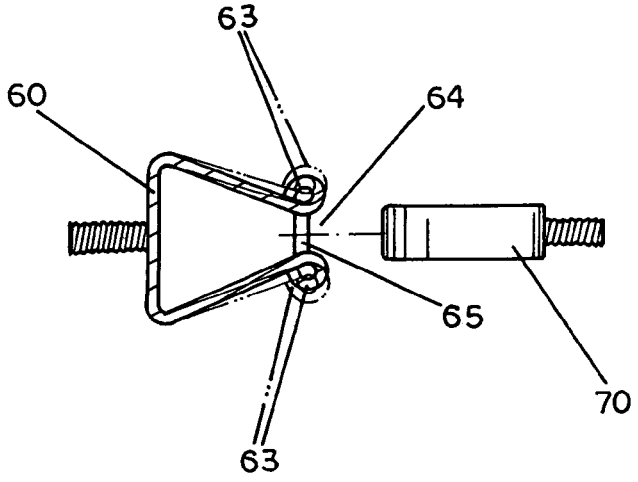
FIG. 17 is top view in section of FIG. 16.
Figure 18:
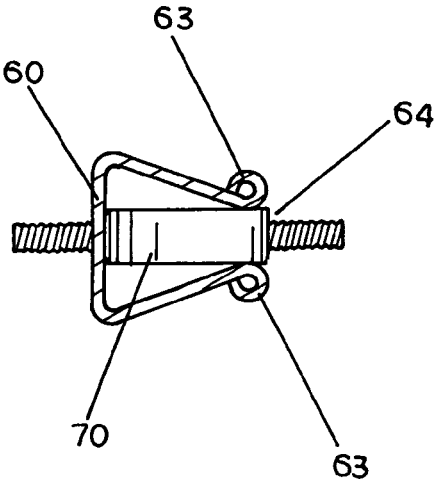
FIG. 18 corresponds to FIG. 17, showing the male connecting member fastened to the female connecting member.
Figure 19:
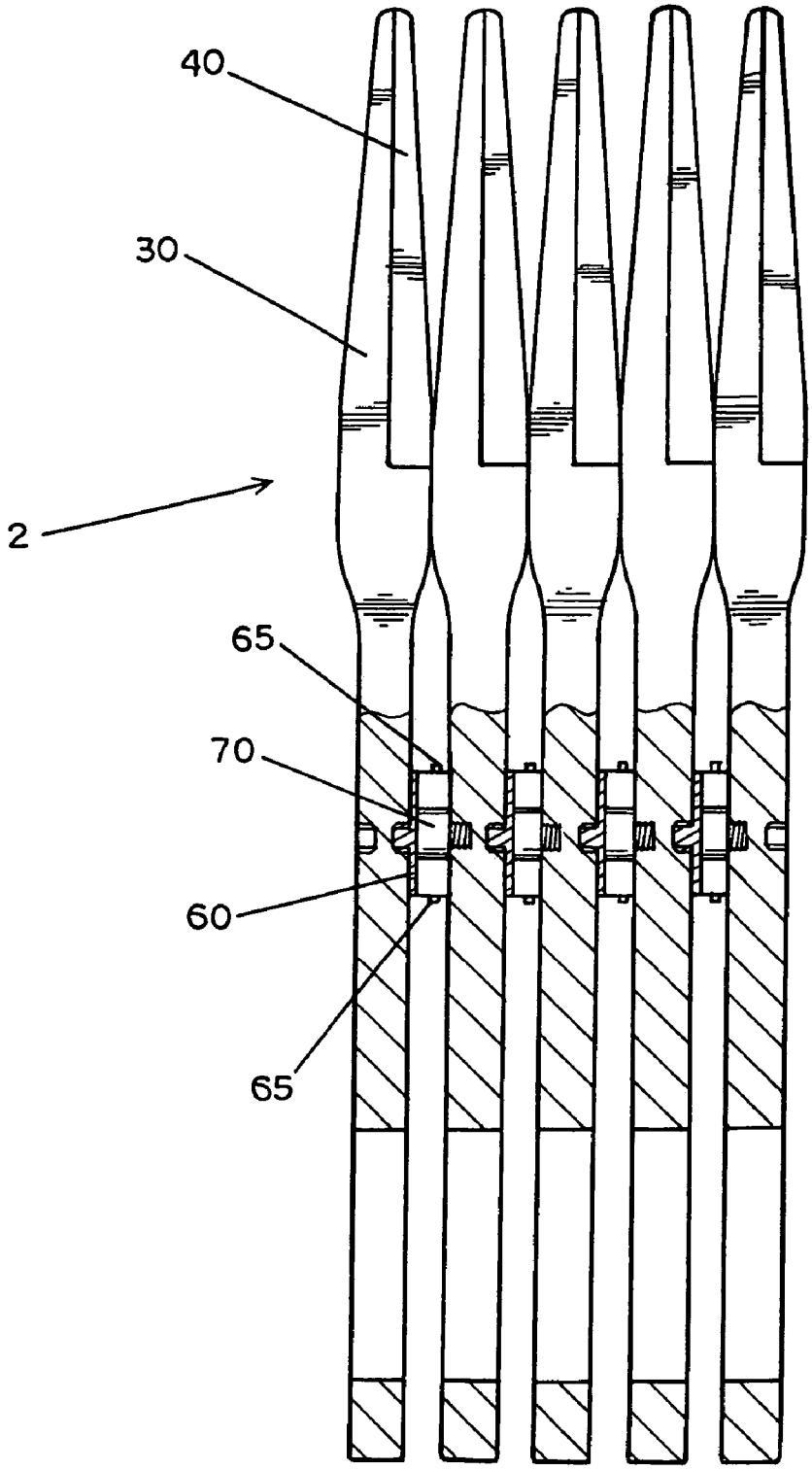
FIG. 19 a sectional view showing plural pairs of hairdressing scissors connected in parallel at the same elevation according to the fourth embodiment of the present invention.
Figure 20:
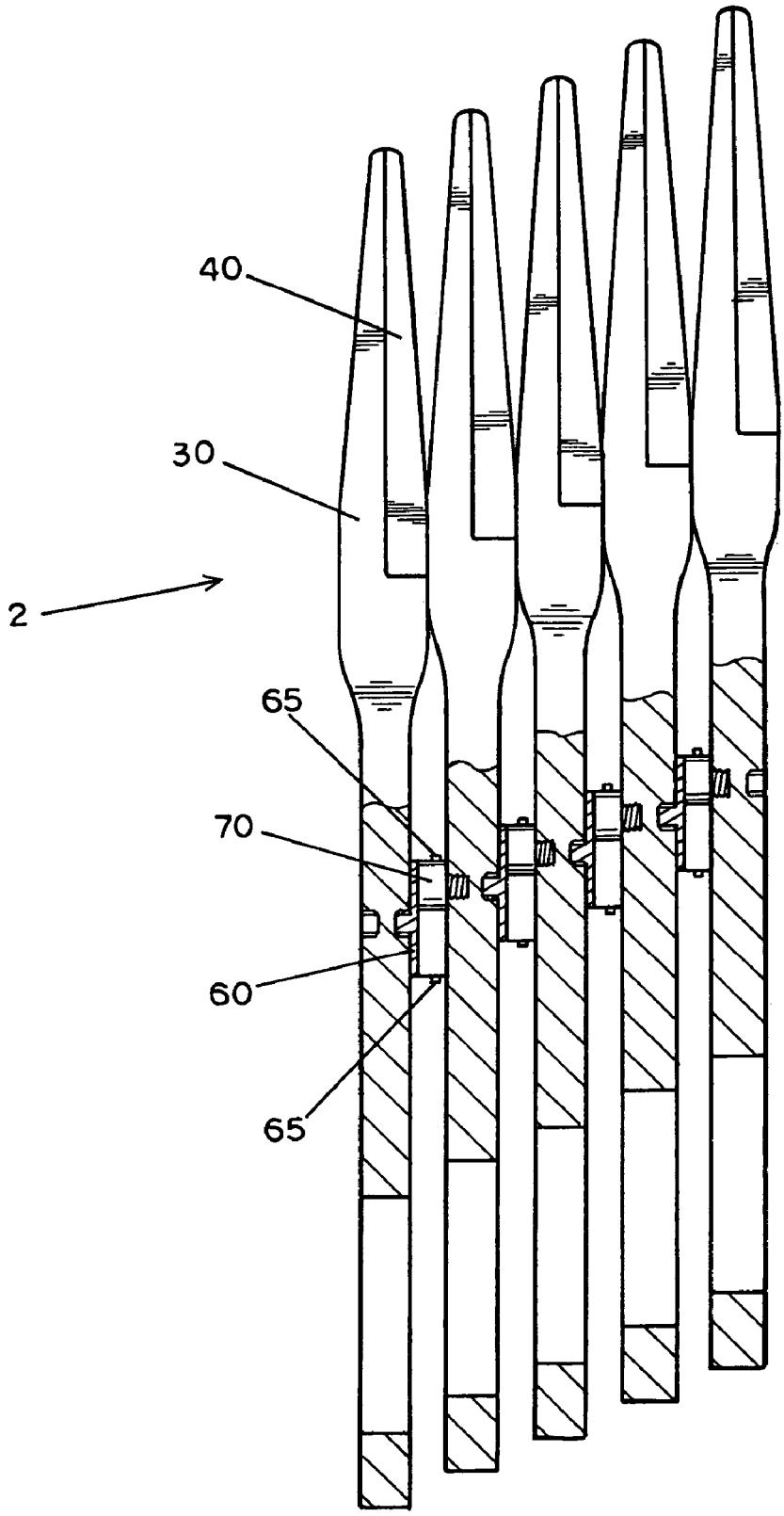
FIG. 20 is a sectional view showing plural pairs of hairdressing scissors connected in parallel at different elevations according to the fourth embodiment of the present invention.

FIGS. 15 and 16 show a combination hairdressing scissor assembly 2 according to the fourth embodiment of the present invention. This embodiment is substantially similar to the aforesaid embodiment with the exception of the structure of the female connecting member and the male connecting member. According to this embodiment, the female connecting member 60 is a hollow triangular frame member having two clamping arms 63, an opening 64 defined between the clamping arms 63, and two elastic stop strips 65 connected between the clamping arms 63 at top and bottom sides of the opening 64. The male connecting member 70 has a height smaller than the height of the opening 64 between the elastic stop strips 65.

Referring to FIGS. 17~20, by means of inserting the male connecting member 70 into the opening 64 of the corresponding female connecting member 60 to expand the clamping arms 63, the male connecting member 70 is firmly secured to the corresponding female connecting member 60. Therefore, by means of fastening the male connecting members 70 at one pair of scissors to the female connecting members 60 at another pair of scissors, plural pairs of scissors 2 are connected in parallel at the same elevation (see FIG. 19) or at different elevations (see FIG. 20).

Figure 21:
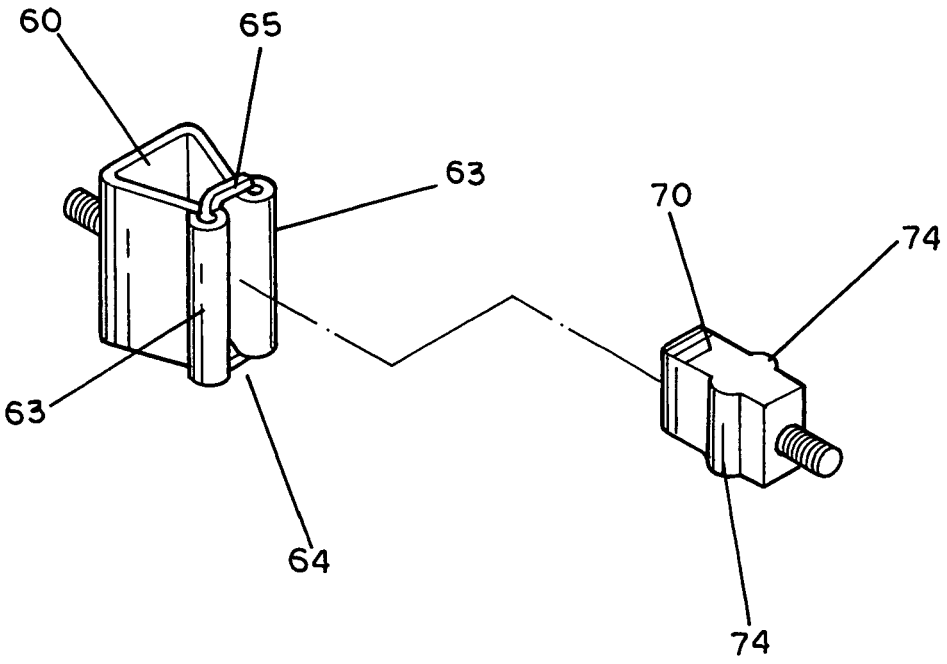
FIG. 21 is a perspective view of a female connecting member and a male connecting member for the combination hairdressing scissor assembly according to the fifth embodiment of the present invention.
Figure 22:
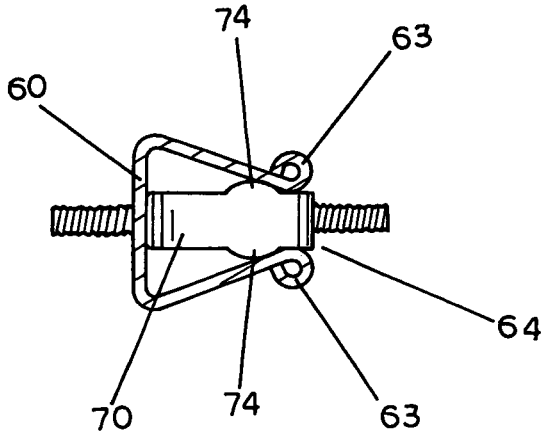
FIG. 22 is a sectional assembly view of FIG. 21.
Figure 23:
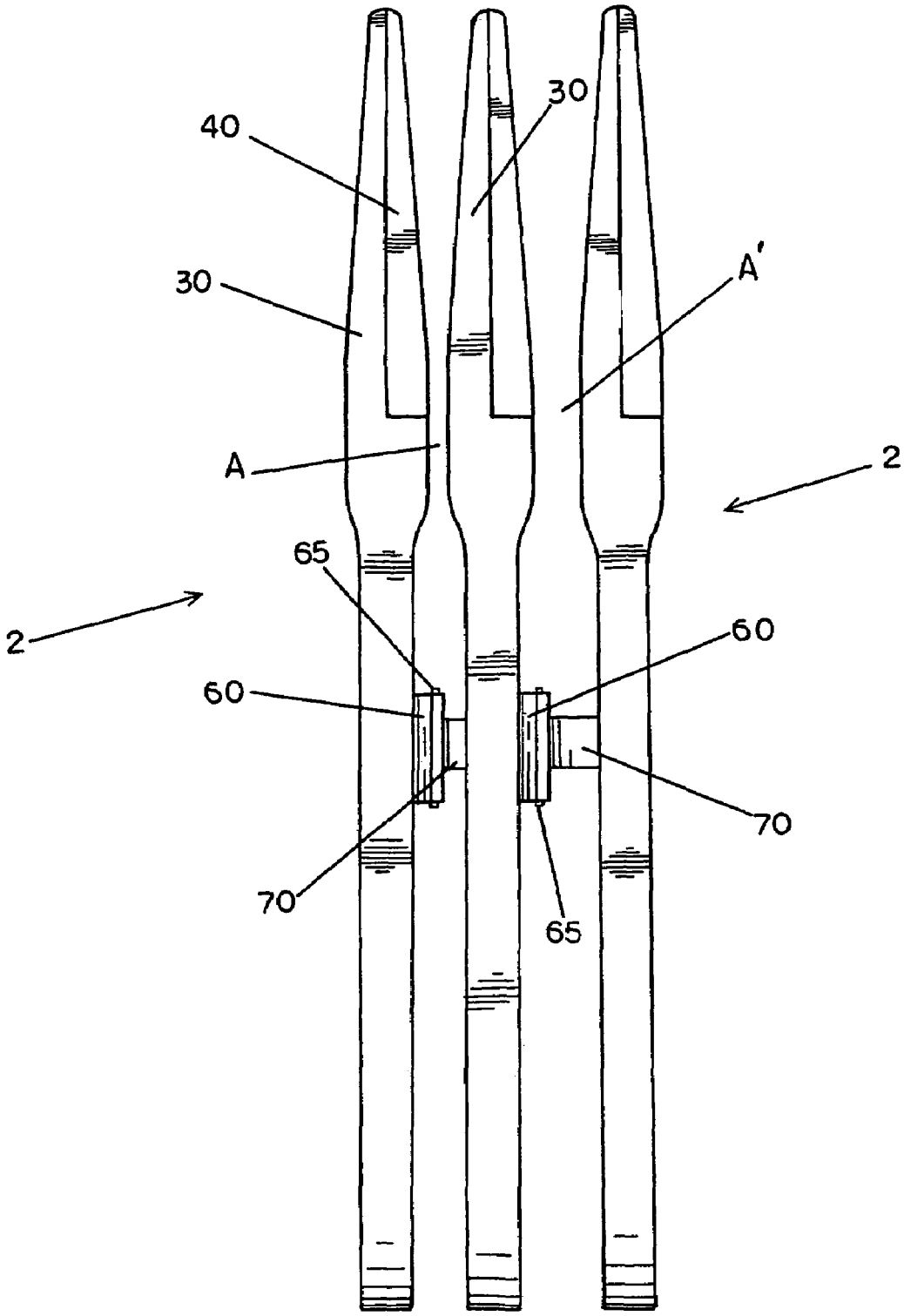
FIG. 23 is a sectional view showing plural pairs of hairdressing scissors connected in parallel at the same elevation and spaced from one another at a different pitch according to the fifth embodiment of the present invention.

FIG. 21 is a perspective view of a female connecting member and a male connecting member for the combination hairdressing scissor assembly according to the fifth embodiment of the present invention. FIG. 22 is a sectional assembly view of FIG. 21. FIG. 23 is a sectional view showing plural pairs of hairdressing scissors connected in parallel at the same elevation and spaced from one another at a different pitch according to the fifth embodiment of the present invention. According to this fifth embodiment, the female connecting member 60 is same as the aforesaid fourth embodiment, however the male connecting member 70 according to this fifth embodiment has two convex portions 74 at two sides that enhance engagement between the female connecting member 60 and the corresponding male connecting member 70.

Figure 24:
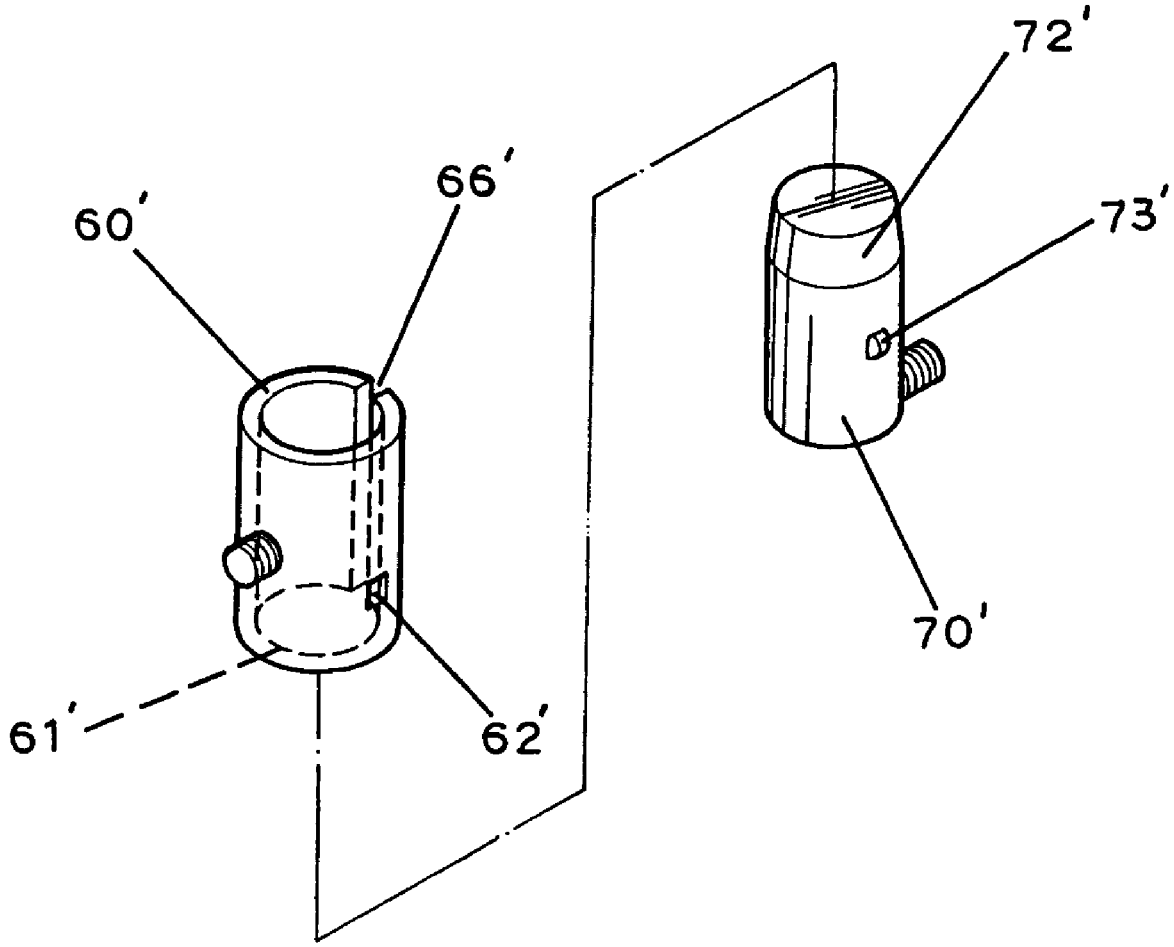
FIG. 24 is a perspective view of a female connecting member and a male connecting member for the combination hairdressing scissor assembly according to the sixth embodiment of the present invention.

FIG. 24 is a perspective view of a female connecting member and a male connecting member for the combination hairdressing scissor assembly according to the sixth embodiment of the present invention. According to this embodiment, the female connecting member 60' is a split tube having an open chamber 61' extending through the top and bottom ends, a longitudinal crevice 66' cut through the peripheral wall and extending through the top and bottom ends, and a retaining hole 62' cut through the peripheral wall in communication with the open chamber 61'. The male connecting member 70' is a solid cylindrical member having a beveled front guide portion 72' and a retaining stub rod 73' protruded from the periphery corresponding to the retaining hole 62'. By means of inserting the male connecting member 70' vertically into the inside of the open chamber 61' of the female connecting member 60' to force the retaining stub rod 73' into engagement with the retaining hole 62', the male connecting member 70' and the female connecting member 60' are fastened together.

1. By means of forcing the parallel insertion blocks 71 or 71' into the open chamber 61 or 61' to engage the retaining stub rod 73 or 73' into the retaining hole 62 or 62', each male connecting member 70 or 70' is fastened to the corresponding female connecting member 60 or 60', and a plural pairs of hairdressing scissors 2 are connected in parallel for operation with one single hand.

2. By means of using different lengths of male connecting members 70 or different diameters of female connecting members 60', the pitch A or A' between each two adjacent pairs of hairdressing scissors 2 is relatively changed to fit different cutting requirements.

3. The male connecting member 70 can be moved vertically relative to the female connecting member 60 after its insertion into an opening 64, and then secured to the female connecting member 60 in position by the clamping arms 63, such that a plural pairs of the hairdressing scissors 2 can be fastened together in parallel at different elevations for operation with one single hand to trim the hair.

Although particular embodiments of the invention have been described in detail for purposes of illustration, various modifications and enhancements may be made without departing from the spirit and scope of the invention.

What the invention claimed is:

1. A combination hairdressing scissor assembly comprising a plurality of hairdressing scissors, said hairdressing scissors each comprising two cutting members pivotally connected together;

a plurality of rectangular female connecting members, each female connecting member having a receiving open chamber formed by four lateral sides forming a rectangular opening facing the front side thereof, and a retaining hole in one of said lateral sides in communication with said receiving open chamber;

a plurality of male connecting members, each male connecting member having a base, two parallel insertion blocks attached to the base and having substantially laterally parallel outer side surfaces forming a rectangular cross-section insertable into said receiving open chamber, each insertion block having a beveled front guide portion intersecting with said outer side surface, and a retaining stub rod protruding from said outer side surface of one of said insertion blocks, positioned to engage said retaining hole in one of said female connecting members, thereby retaining said male and said female connecting members in the engaged position in a removeable non-locking manner;

wherein said plurality of female connecting members and said plurality of male connecting members are symmetrically provided at two opposite sides of each of said hairdressing scissors for enabling said pairs of hairdressing scissors to be connected in parallel by engaging the male connecting members of one of said hairdressing scissors into the corresponding female connecting members of another of said hairdressing scissors, each said male connecting member being removably engageable in a non-locking manner into the receiving open chamber of the corresponding female connecting member by lateral force applied to the scissors.

* * * * *